US011308903B2

(12) United States Patent
Liang

(10) Patent No.: US 11,308,903 B2
(45) Date of Patent: Apr. 19, 2022

(54) SOURCE DRIVING DEVICE, POLARITY REVERSAL CONTROL METHOD THEREOF, AND LIQUID CRYSTAL DISPLAY DEVICE

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventor: Hengzhen Liang, Beijing (CN)

(73) Assignees: BOE TECHNOLOGY GROUP CO., LTD., Beijing (CN); HEFEI XINSHENG OPTOELECTRONICS, TECHNOLOGY CO., LTD.

( * ) Notice: Subject to any disclaimer, the term of this patent is extended or adjusted under 35 U.S.C. 154(b) by 890 days.

(21) Appl. No.: 16/066,754

(22) PCT Filed: Oct. 10, 2017

(86) PCT No.: PCT/CN2017/105504

§ 371 (c)(1),
(2) Date: Jun. 28, 2018

(87) PCT Pub. No.: WO2018/126753

PCT Pub. Date: Jul. 12, 2018

(65) Prior Publication Data

US 2021/0174755 A1 Jun. 10, 2021

(30) Foreign Application Priority Data

Jan. 5, 2017 (CN) ..... 201710008436.9

(51) Int. Cl.
*G09G 3/36* (2006.01)

(52) U.S. Cl.
CPC ... *G09G 3/3614* (2013.01); *G09G 2320/0257* (2013.01)

(58) Field of Classification Search
CPC ..... G09G 3/3614; G09G 2320/0257; G09G 3/3685
See application file for complete search history.

(56) References Cited

U.S. PATENT DOCUMENTS 4,926,168 A * 5/1990 Yamamoto ..... G09G 3/3614 345/209
6,388,653 B1 * 5/2002 Goto ..... G09G 3/3688 345/96

(Continued)

FOREIGN PATENT DOCUMENTS

CN 1684136 A 10/2005
CN 101226724 B 1/2011

(Continued)

OTHER PUBLICATIONS

Second Office Action for Chinese Patent Application No. 201710008436.9 dated Jan. 23, 2019.

(Continued)

*Primary Examiner* — Michael J Jansen, II
(74) *Attorney, Agent, or Firm* — Calfee, Halter & Griswold LLP

(57) ABSTRACT

A source driving device, a polarity reversal control method thereof, and a liquid crystal display device. In the source driving device, a polarity signal control unit is added, and an output terminal of the polarity signal control unit is connected to control terminals of a first channel selection circuit and a second channel selection circuit in a positive-negative polarity reversal control unit, respectively. Polarity reversal condition of the polarity reversal control signal outputted by the polarity signal control unit is controlled using a trigger control signal inputted to a control terminal of the polarity signal control unit.

10 Claims, 3 Drawing Sheets

(56) References Cited

U.S. PATENT DOCUMENTS 6,680,722 B1 * 1/2004 Hiraki ..... G09G 3/3614 345/96
7,098,884 B2 * 8/2006 Onoya ..... G09G 3/3614 345/96
7,362,299 B2 * 4/2008 Hosotani ..... G09G 3/2092 345/96
7,477,227 B2 * 1/2009 Hashimoto ..... G09G 3/3611 345/100
7,499,010 B2 * 3/2009 Mizumaki ..... G09G 3/3611 345/204
7,623,106 B2 * 11/2009 Onoya ..... G09G 3/3614 345/96
7,920,136 B2 * 4/2011 Stewart ..... G09G 3/3466 345/204
8,319,717 B2 * 11/2012 Kim ..... G09G 3/3614 345/96
9,972,257 B2 * 5/2018 Yang ..... G09G 3/3614
2001/0034075 A1 * 10/2001 Onoya ..... G09G 3/3614 438/34
2002/0093475 A1 7/2002 Hashimoto
2004/0178979 A1 * 9/2004 Watanabe ..... G09G 3/3614 345/96
2004/0246280 A1 * 12/2004 Credelle ..... G09G 3/3685 345/692
2005/0068282 A1 * 3/2005 Mizumaki ..... G09G 3/3611 345/89
2005/0093806 A1 * 5/2005 Hosotani ..... G09G 3/3614 345/96
2005/0275612 A1 * 12/2005 Chou ..... G09G 3/3614 345/96
2006/0061532 A1 * 3/2006 Hashimoto ..... G09G 3/3685 345/89
2006/0250335 A1 * 11/2006 Stewart ..... G09G 3/3466 345/84
2006/0267898 A1 * 11/2006 Onoya ..... G09G 3/3614 345/96
2006/0274010 A1 * 12/2006 Tang ..... G09G 3/3648 345/94
2007/0115243 A1 5/2007 Kim et al.
2008/0170024 A1 7/2008 Song et al.
2008/0278426 A1 * 11/2008 Chen ..... G09G 3/3614 345/96
2008/0309656 A1 * 12/2008 Van Woudenberg ..... G09G 3/3614 345/214
2009/0310077 A1 * 12/2009 Kim ..... G09G 3/3614 349/151
2011/0134092 A1 6/2011 Lee et al.
2014/0043311 A1 2/2014 Shao et al.
2014/0176411 A1 * 6/2014 Yang ..... G09G 3/3614 345/96
2017/0103723 A1 * 4/2017 Chen ..... G09G 3/3696
2017/0213501 A1 * 7/2017 Lim ..... G09G 3/2003

FOREIGN PATENT DOCUMENTS

CN 102810301 A 12/2012
CN 102831869 A 12/2012
CN 102930840 A 2/2013
CN 103021366 A 4/2013
CN 106486086 A 3/2017
TW 200405253 A 4/2004

OTHER PUBLICATIONS

Search Report and Written Opinion for International Application No. PCT/CN2017/105504 dated Dec. 29, 2017.
First Office Action for Chinese Patent Application No. 201710008436.9 dated Aug. 1, 2018.

* cited by examiner

SOURCE DRIVING DEVICE, POLARITY REVERSAL CONTROL METHOD THEREOF, AND LIQUID CRYSTAL DISPLAY DEVICE

RELATED APPLICATION

The present application is the U.S. national phase entry of PCT/CN2017/105504, with an international filing date of Oct. 10, 2017, which claims the benefit of Chinese Patent Application No. 201710008436.9, filed on Jan. 5, 2017, the entire disclosure of which is incorporated herein by reference.

FIELD

The present disclosure relates to the field of liquid crystal display technologies, and particularly to a source driving device, a polarity reversal control method thereof, and a liquid crystal display device.

BACKGROUND

Thin Film Transistor Liquid Crystal Displays (TFT-LCDs) utilize optical anisotropy and birefringence characteristic of liquid crystal molecules to display images. Specifically, a TFT-LCD generates an electric field through surface electrodes of a substrate according to a video signal, and the electric field changes arrangement orientation of liquid crystal molecules, thereby controlling light transmittance of a liquid crystal cell, and further realizing display of images. In general, a TFT-LCD is driven by an alternating voltage polarity method. In such a driving method, polarity of voltage is alternated between adjacent liquid crystal cells and between successive frame periods in order to reduce deterioration of the liquid crystal, so that the liquid crystal can maintain normal characteristics for a long time, thereby maintaining normal display for a long time. If any of two polarities of a data voltage is dominantly provided for a long time, a direct current (DC) signal remains. After a certain period of time, the residual DC signal will affect the characteristics of the liquid crystal, resulting in abnormal display and generating a ghosting signal.

SUMMARY

In view of this, embodiments of the present disclosure provide a source driving device, a polarity reversal control method thereof, and a liquid crystal display device that can at least partially alleviate or even eliminate one or more of the above-mentioned problems.

Correspondingly, embodiments of the present disclosure provide a source driving device comprising a positive-negative polarity reversal control unit and a polarity signal control unit. The positive-negative polarity reversal control unit comprises: a first channel selection circuit, a negative voltage channel and a positive voltage channel, and a second channel selection circuit which are connected successively. The first channel selection circuit is connected to two signal input terminals, respectively, and the second channel selection circuit is connected to two signal output terminals, respectively. The polarity signal control unit comprises an input terminal configured to receive a polarity reversal control signal, a control terminal configured to receive a trigger control signal, and an output terminal connected to control terminals of the first channel selection circuit and the second channel selection circuit, respectively. The polarity signal control unit is configured to output the received polarity reversal control signal, perform polarity reversal on a polarity reversal control signal to be outputted in response to receiving a valid trigger control signal, and perform polarity reversal again on the polarity reversal control signal to be outputted in response to receiving the valid trigger control signal again.

It is to noted that the terms "polarity transformation", "polarity reversal", "reverse" and derivatives thereof used throughout the present disclosure all refer to reversing a positive signal to a corresponding negative signal, and reversing a negative signal to a corresponding positive signal, or reversing a high signal to a low signal, and reversing a low signal to a high signal.

It is to be further noted that the term "valid" trigger control signal used throughout the present disclosure refers to a trigger control signal that causes the polarity signal control unit to reverse the polarity reversal control signal. Depending on the use case, the "valid" trigger control signal may be a high-level signal or a low-level signal.

In an example embodiment, in the above source driving device, a plurality of polarity signal control units are disposed in one-to-one correspondence with a plurality of positive-negative polarity reversal control units, and input terminals of the plurality of polarity signal control units are connected to a same polarity reversal control signal input terminal.

In an example embodiment, the above source driving device further comprises a shift controller. The shift controller comprises an input terminal configured to receive a trigger signal, and a plurality of output terminals connected in one-to-one correspondence with control terminals of the plurality of polarity signal control units. The shift controller is configured to, in response to receiving a valid trigger signal, output the valid trigger control signal to the control terminals of the plurality of polarity signal control units successively in order.

In an example embodiment, the above source driving device further comprises a random controller. The random controller comprises an input terminal configured to receive a trigger signal, and a plurality of output terminals connected in one-to-one correspondence with control terminals of the plurality of polarity signal control units. The random controller is configured to, in response to receiving a valid trigger signal, output the valid trigger control signal to a control terminal of one of the plurality of polarity signal control units at a time in a random order, and output the valid trigger control signal to a control terminal of each of the plurality of polarity signal control units once successively in a random order within one period after the valid trigger signal is received each time.

In an example embodiment, in the above source driving device, the control terminal of the polarity signal control unit receives the valid trigger control signal once every 2n-frame time, n being a positive integer.

In another embodiment is provided a liquid crystal display device comprising any of the source driving devices provided above by embodiments of the present disclosure.

In a further embodiment is provided a polarity reversal control method of a source driving device. The source driving device comprises a positive-negative polarity reversal control unit and a polarity signal control unit. The positive-negative polarity reversal control unit comprises a first channel selection circuit, a negative voltage channel and a positive voltage channel, and a second channel selection circuit which are connected to successively. The first channel selection circuit is connected to two signal input terminals, respectively, and the second channel selection circuit being connected to two signal output terminals, respectively. The polarity signal control unit comprises an input terminal configured to receive a polarity reversal control signal, a control terminal configured to receive a trigger control signal, and an output terminal connected to control terminals of the first channel selection circuit and the second channel selection circuit, respectively.

The polarity reversal control method comprises: outputting, by the polarity signal control unit, the received polarity reversal control signal to the control terminals of the first channel selection circuit and the second channel selection circuit to which the polarity signal control unit connected, performing polarity reversal on a polarity reversal control signal to be outputted in response to receiving a valid trigger control signal, and performing polarity reversal again on the polarity reversal control signal to be outputted in response to receiving the valid trigger control signal again.

In an example embodiment, in the above polarity reversal control method, a plurality of polarity signal control units are disposed in one-to-one correspondence with a plurality of positive-negative polarity reversal control units, and input terminals of the plurality of polarity signal control units are connected to a same polarity reversal control signal input terminal. At that time, the polarity reversal control method further comprises receiving, by the plurality of polarity signal control units, the polarity reversal control signal outputted by the same polarity reversal control signal input terminal.

In an example embodiment, in the above polarity reversal control method, the source driving device further comprises a shift controller. The shift controller comprises an input terminal configured to receive a trigger signal, and a plurality of output terminals connected in one-to-one correspondence with the control terminals of the plurality of polarity signal control units. At that time, the polarity reversal control method further comprises: outputting, by the shift controller, in response to receiving a valid trigger signal, a valid trigger control signal to the control terminals of the plurality of polarity signal control units successively in order.

In an example embodiment, in the above polarity reversal control method, the source driving device further comprises a random controller. The random controller comprises an input terminal configured to receive a trigger signal, and a plurality of output terminals connected in one-to-one correspondence with the control terminals of the plurality of polarity signal control units. At that time, the polarity reversal control method further comprises: outputting, by the random controller, in response to receiving a valid trigger signal, the valid trigger control signal to a control terminal of one of the plurality of polarity signal control units at a time in a random order, and outputting the valid trigger control signal to a control terminal of each of the plurality of polarity signal control units once successively in a random order within one period after the valid trigger signal is received each time.

In an example embodiment, the above polarity reversal control method further comprises receiving, by the polarity signal control unit, the trigger control signal once every 2n-frame time, n being a positive integer.

DETAILED DESCRIPTION

Embodiments of a source driving device, a polarity reversal control method thereof, and a liquid crystal display device will be described in detail below with reference to the accompanying drawings.

Television (TV) signals on the market mainly employ interlace and interleave modes, and a resolution adjustment circuit (TV Scaler) has a two-dimensional De-Interlace (2D De-Interlace) mode and a three-dimensional De-Interlace (3D De-Interlace) mode. A Line Buffer function is used in the 2D De-Interlace mode, wherein signals of an Interlace row are calculated using several rows of signals before and after the Interlace row, thus the signal storage amount is small. In the 3D De-Interlace mode, signals of the Interlace row is obtained from calculation by comparing frame signals, thus there is a need for a storage unit with a large storage amount for storing signals of at least two frames. Since in the 2D De-Interlace mode, only a few rows of data in a current frame are simply subjected to data processing, and the true value of data of the current row cannot be obtained, the calculated result inevitably differs from the true value of a next frame. Therefore, when the polarity of voltage is alternated (that is, the polarity is reversed), there is a DC difference value. If a static picture is played for a long time, a ghosting signal caused by long-time DC signal residue will occur. However, low-end televisions on the market generally adopt the 2D De-Interlace mode in consideration of the cost. This will inevitably lead to the problem of ghosting signal.

Therefore, in the existing liquid crystal display driving methods, display of a liquid crystal display needs to be driven by positive-negative voltages. However, since a front-end system processes signals differently, there will be a deviation between positive-negative voltages which should have the same absolute value, so that long-time DC signal residue results in polarization of the liquid crystal, thereby generating a ghost phenomenon.

Figure 1:
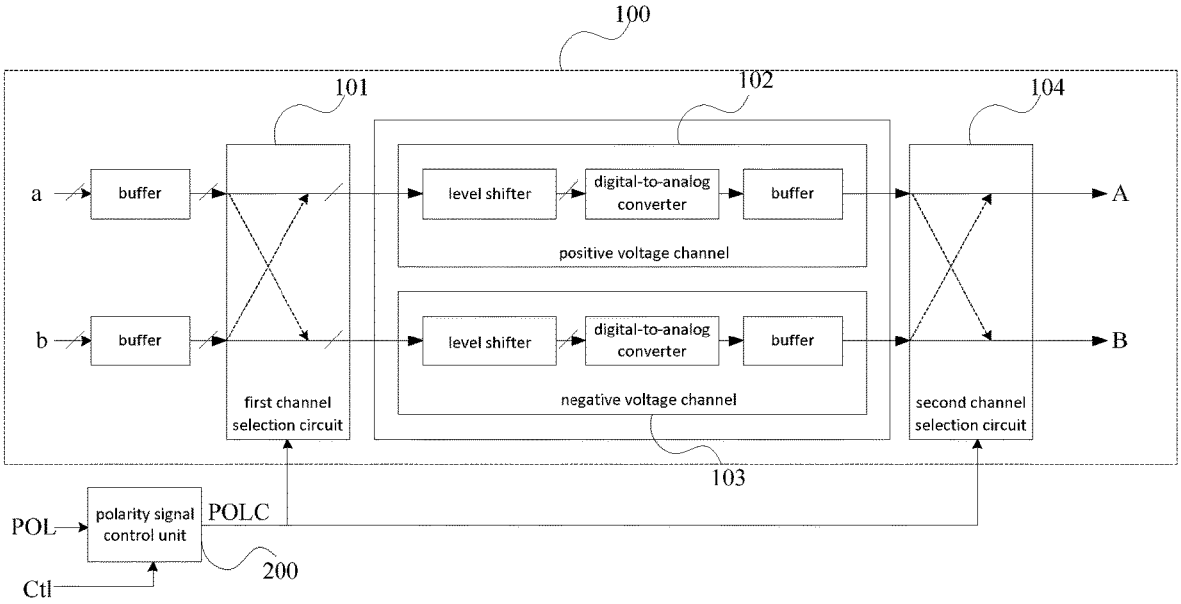
FIG. 1 is a schematic structural diagram of a source driving device provided by embodiments of the present disclosure.

A source driving device provided by embodiments of the present disclosure, as shown in FIG. 1, comprises: a positive-negative polarity reversal control unit 100, and a polarity signal control unit 200. The positive-negative polarity reversal control unit 100 comprises a first channel selection circuit 101, a positive voltage channel 102 and a negative voltage channel 103, and a second channel selection circuit 104 which are connected successively. The first channel selection circuit 101 is connected to two signal input terminals a and b, respectively, and the second channel selection circuit 104 is connected to two signal output terminals A and B, respectively.

The polarity signal control unit 200 comprises: an input terminal configured to receive a polarity reversal control signal POL, a control terminal configured to receive a trigger control signal Ctl, and an output terminal connected to control terminals of the first channel selection circuit 101 and the second channel selection circuit 104, respectively. The polarity signal control unit 200 is configured to output the received polarity reversal control signal POL. Assume that a polarity reversal control signal to be outputted is POLC, the polarity signal control unit 200 performs polarity reversal on the polarity reversal control signal to be outputted POLC after receiving a valid trigger control signal Ctl, and performs polarity reversal again on the polarity reversal control signal to be outputted POLC after receiving the valid trigger control signal Ctl again.

Figure 2:
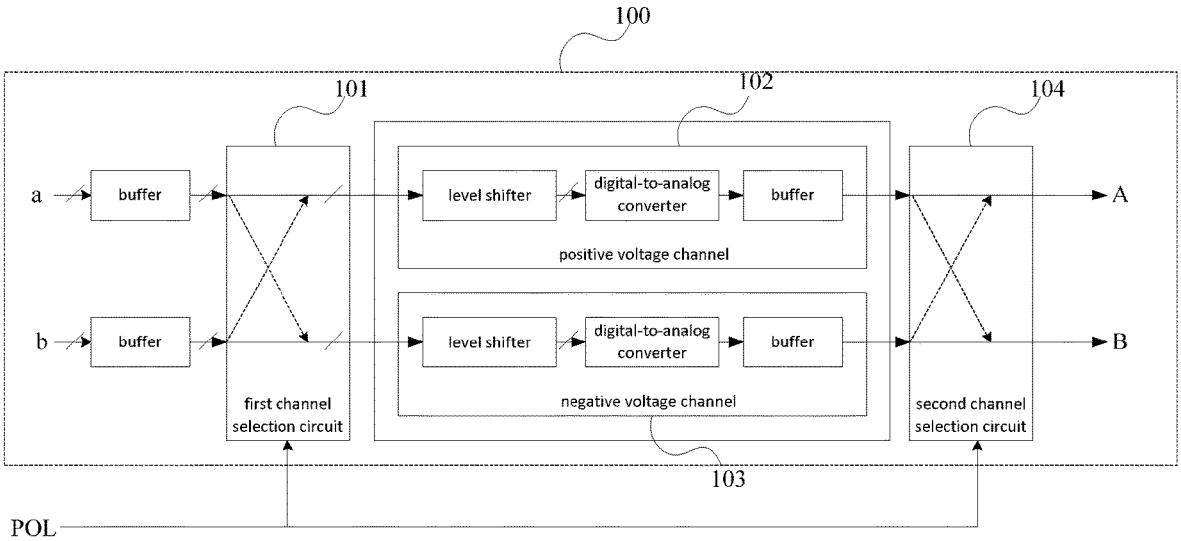
FIG. 2 is a schematic structural diagram of a typical source driving device.

In the above source driving device provided by embodiments of the present disclosure, the polarity signal control unit 200 is added, the output terminal of which is connected to the control terminals of the first channel selection circuit 101 and the second channel selection circuit 104 in the positive-negative polarity reversal control unit 100, respectively. Compared to a typical scheme in which the polarity reversal control signal POL is directly inputted to the control terminals of the above two circuits (see FIG. 2), the polarity reversal control signal POL in the source driving device provided by embodiments of the present disclosure is inputted to the control terminals of the above two circuits only after passing through the polarity signal control unit 200. Polarity reversal condition of the polarity reversal control signal POLC outputted by the polarity signal control unit 200 is controlled using the trigger control signal Ctl inputted to the control terminal of the polarity signal control unit 200. Specifically, after the control terminal of the polarity signal control unit 200 receives the valid trigger control signal Ctl, the polarity signal control unit 200 will reverse the polarity of the polarity reversal control signal POLC which is originally to be outputted and then output it. After the control terminal of the polarity signal control unit 200 receives the valid trigger control signal Ctl again, the polarity signal control unit 200 will reverse the polarity of the polarity reversal control signal POLC which is originally to be outputted again and then output it. The positive-negative polarity reversal control unit 100 controls the polarity of the output signal according to the received polarity reversal control signal, thereby effectively avoiding possible DC signal residue in the 2D De-Interlace mode, as well as random DC signal residue caused by poor quality of a front-end signal, or DC signal residue caused by other reasons, and further eliminating the ghost phenomenon resulting from the DC signal residue.

In the above source driving device provided by embodiments of the present disclosure, the positive-negative polarity reversal control unit 100 can adopt a conventional structure, thus the internal structure of each circuit in the positive-negative polarity reversal control unit 100 is not described in detail here.

Figure 3:
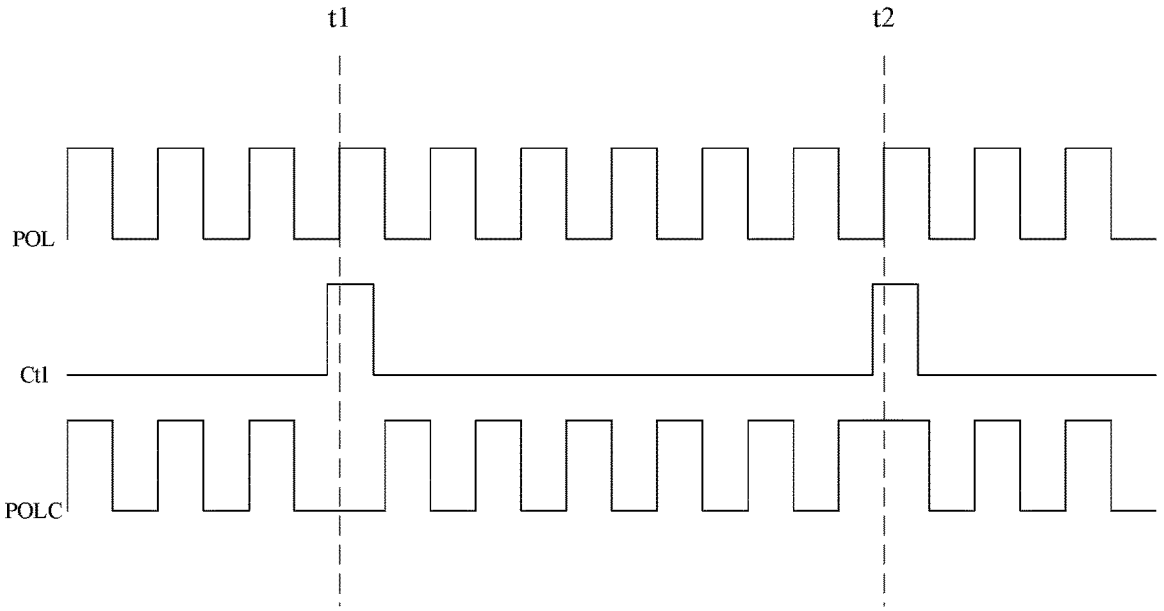
FIG. 3 is a timing diagram of a polarity signal control unit in a source driving device provided by embodiments of the present disclosure.

Specifically, in the above source driving device provided by embodiments of the present disclosure, as shown in FIG. 3, the polarity reversal control signal POL received by the input terminal of the polarity signal control unit 200 is a periodically changing clock signal. Before the control terminal of the polarity signal control unit 200 receives the valid (high level in the example of FIG. 3) trigger control signal Ctl, the polarity reversal control signal POLC outputted by the output terminal of the polarity signal control unit 200 is the same as the inputted polarity reversal control signal POL, i.e. POLC=POL. After the control terminal of the polarity signal control unit 200 receives the valid trigger control signal Ctl (i.e. Ctl is at a high potential), the polarity signal control unit 200 performs polarity reversal on the polarity reversal control signal POLC to be outputted from time t1, i.e. POLC=reversed POL, and thereafter, although the trigger control signal Ctl changes to a low potential, the polarity signal control unit 200 still performs polarity reversal on the polarity reversal control signal POLC to be outputted, until the control terminal of the polarity signal control unit 200 receives the valid trigger control signal Ctl again. After the control terminal of the polarity signal control unit 200 receives the valid trigger control signal Ctl again, the polarity signal control unit 200 performs polarity reversal on the polarity reversal control signal POLC to be outputted again from time t2, i.e. POLC=reversed (reversed POL)=POL. That is, from the time t2, the polarity reversal control signal POLC outputted by the output terminal of the polarity reversal control unit 200 is the same as the inputted polarity reversal control signal POL. Thereafter, the above cycle is repeated.

By forcing the polarity reversal control signal POLC to be outputted to undergo polarity reversal after the control terminal of the polarity signal control unit 200 receives a valid trigger control signal Ctl each time, it is possible to avoid the ghosting signal phenomenon resulting from long-time DC signal residue.

In the above source driving device provided by embodiments of the present disclosure, in order to prevent the trigger control signal Ctl from destroying the original balance between positive and negative polarities, it is necessary to ensure that the control terminal of the polarity signal control unit 200 receives the trigger control signal Ctl once every 2n-frame time so as to perform polarity reversal, wherein n is a positive integer. That is, the minimum period of the trigger control signal Ctl can be equal to two-frame time, i.e. the trigger control signal Ctl can be inputted once every two frames.

In the above source driving device provided by embodiments of the present disclosure, since it is necessary to drive all data lines in a liquid crystal display panel, multiple pairs of positive-negative polarity reversal control units 100 are generally arranged, and each pair of positive-negative polarity reversal control units 100 outputs data signals to two data lines adjacent to them. In one arrangement, only one polarity signal control unit 200 may be arranged in the source driving device, which is connected to control terminals of the first channel selection circuits 101 and the second channel selection circuits 104 in all the positive-negative polarity reversal control units 100. In this way, all the positive-negative polarity reversal control units 100 will receive the polarity-reversed polarity reversal control signal POLC simultaneously, that is, the polarity reversal control signals POLC received at the same time are the same. However, in such a scheme, when the polarity is being reversed, a sudden change easily occurs in the brightness of an entire screen of the display panel, leading to a problem of flickers.

Figure 4:
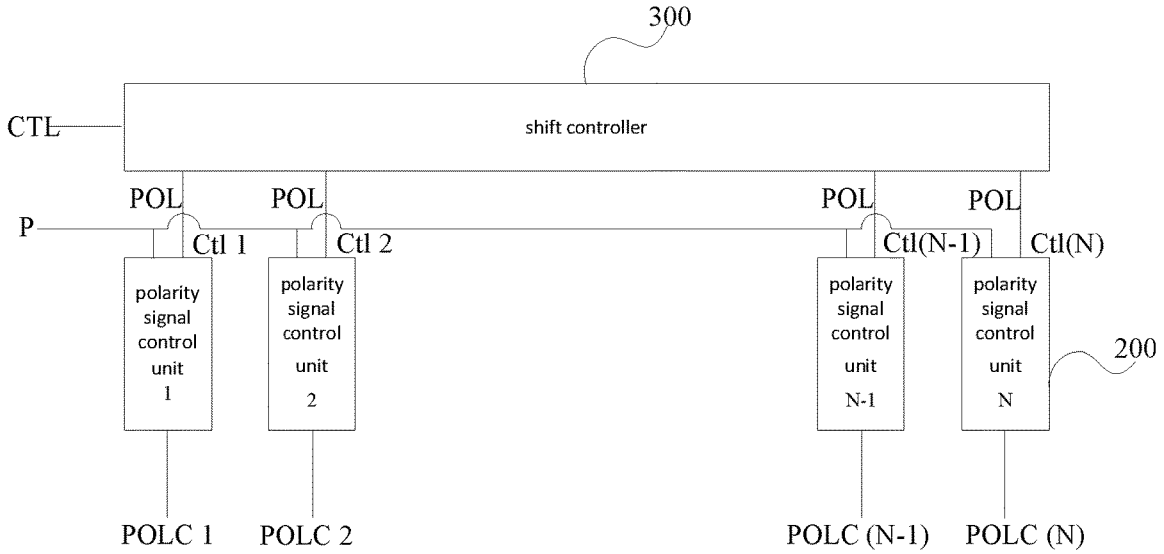
FIG. 4 is a partial schematic structural diagram of a source driving device provided by embodiments of the present disclosure.
Figure 5:
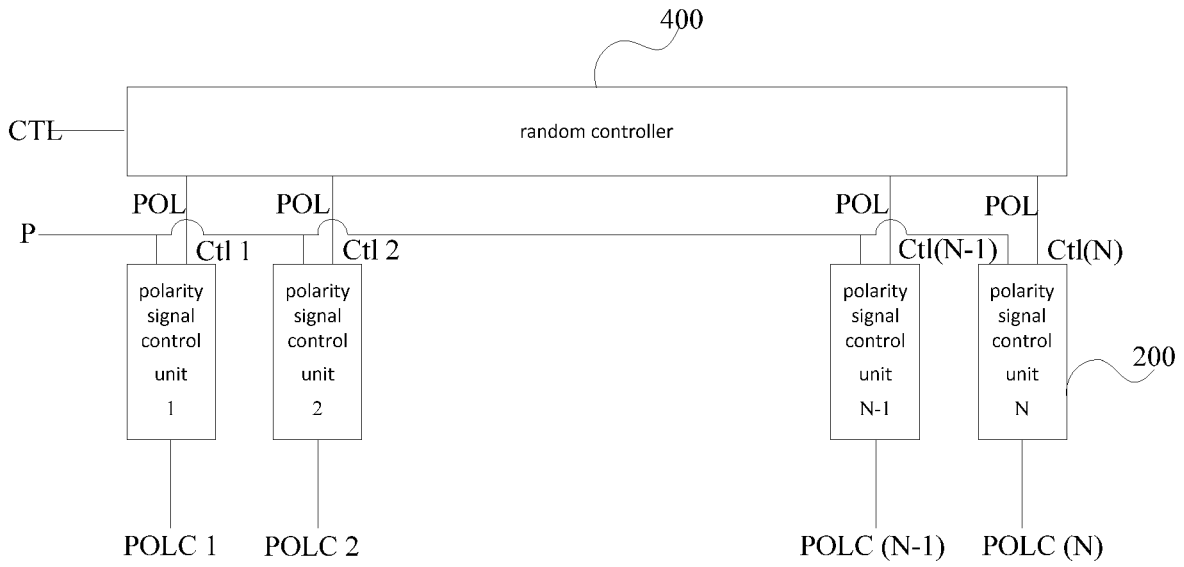
FIG. 5 is a partial schematic structural diagram of a source driving device provided by embodiments of the present disclosure.

In view of this, in the above source driving device provided by embodiments of the present disclosure, as shown in FIGS. 4 and 5, polarity signal control units 200 and positive-negative polarity reversal control units 100 may be arranged in one-to-one correspondence. That is, a plurality of polarity signal control units 200 are arranged, and an input terminal POL of each polarity signal control unit 200 may be connected to the same polarity reversal control signal input terminal P, i.e. receiving the same polarity reversal control signal POL. Afterwards, a control terminal of each polarity signal control unit 200 can receive a valid trigger control signal Ctl at different times so that the polarity change in the display panel occurs in a single direction (e.g. column direction). As a result, the difference in brightness upon polarity reversal is not easily perceived.

In the above source driving device provided by embodiments of the present disclosure, the trigger control signal Ctl can be time-divisionally inputted to different polarity signal control units 200 in the following manners.

In a manner, as shown in FIG. 4, a shift controller 300 is added in the source driving device. The shift controller 300 comprises an input terminal configured to receive a trigger signal CTL, and a plurality of output terminals connected in one-to-one correspondence with the control terminals of the polarity signal control units 200. The shift controller 300 is configured to, in response to receiving the valid trigger signal CTL, output the valid trigger control signal Ctl to the control terminals of the polarity signal control units 200 successively in order.

With the scheme shown in FIG. 4, sequential scanning can be realized. That is, the shift controller 300 sequentially outputs the valid trigger control signal Ctl to the control terminals of the polarity signal control units 200 to which it is connected so that the polarity change in the display panel occurs sequentially in a single direction (e.g. column direction). As a result, the difference in brightness upon polarity reversal is not easily perceived.

In another manner, as shown in FIG. 5, a random controller 400 is added in the source driving device. The random controller 400 comprises an input terminal configured to receive a trigger signal CTL and a plurality of output terminals connected in one-to-one correspondence with the control terminals of the polarity signal control units 200. The random controller 400 is configured to, in response to receiving the valid trigger signal CTL, output the valid trigger control signal Ctl to a control terminal of one polarity signal control unit 200 at a time in a random order, and output the valid trigger control signal Ctl to a control terminals of each of the polarity signal control units 200 once successively in a random order within one period after the valid trigger signal CTL is received each time.

With the scheme shown in FIG. 5, random scanning can be realized. That is, the random controller 400 randomly outputs the valid trigger control signal Ctl to the control terminals of the polarity signal control units 200 to which it is connected, so that the polarity change in the display panel occurs randomly in a single direction (e.g. column direction). As a result, the polarity change in the display panel occurs in a single direction (e.g. column direction) and the difference in brightness upon polarity reversal is not easily perceived.

Embodiments of the present disclosure further provide a polarity reversal control method of a source driving device. Since the principle of the method for solving the problem is similar to that of the source driving device described above, implementation of the method may refer to the implementation of the device. The repeated description is omitted.

Specifically, in the polarity reversal control method of a source driving device provided by embodiments of the present disclosure, as shown in FIG. 1, the source driving device comprises a positive-negative polarity reversal control unit 100 and a polarity signal control unit 200. The positive-negative polarity reversal control unit 100 comprises: a first channel selection circuit 101, a positive voltage channel 102 and a negative voltage channel 103, and a second channel selection circuit 104 which are connected successively. The first channel selection circuit 101 is connected to two signal input terminals, respectively, and the second channel selection circuit 104 is connected with two signal output terminals, respectively. The polarity signal control unit 200 comprises: an input terminal configured to receive a polarity reversal control signal, a control terminal configured to receive a trigger control signal, and an output terminal connected to control terminals of the first channel selection circuit 101 and the second channel selection circuit 104, respectively.

Correspondingly, the above polarity reversal control method provided by embodiments of the present disclosure comprises:

outputting, by the polarity signal control unit 200, the received polarity reversal control signal to the control terminals of the first channel selection circuit 101 and the second channel selection circuit 104 to which the polarity signal control unit 200 is connected, performing polarity reversal on a polarity reversal control signal to be outputted after receiving a valid trigger control signal, and performing polarity reversal on the polarity reversal control signal to be outputted again after receiving the valid trigger control signal again.

In the polarity reversal control method provided by embodiments of the present disclosure, polarity signal control units 200 may be arranged in one-to-one correspondence with positive-negative polarity reversal control units 100, and input terminals of the polarity signal control units 200 are connected to the same polarity reversal control signal input terminal.

Correspondingly, the above polarity reversal control method provided by embodiments of the present disclosure further comprises: receiving, by the polarity signal control units 200, a polarity reversal control signal outputted by the same polarity reversal control signal input terminal.

In the above polarity reversal control method provided by embodiments of the present disclosure, the source driving device may further comprise a shift controller 300 as shown in FIG. 4. The shift controller 300 comprises an input terminal configured to receive a trigger signal, and a plurality of output terminals connected in one-to-one correspondence with the control terminals of the polarity signal control units 200.

Correspondingly, the above polarity reversal control method provided by embodiments of the present disclosure further comprises: outputting, by the shift controller 300, in response to receiving a valid trigger signal, a valid trigger control signal to the control terminals of the polarity signal control units 200 successively in order.

In the above polarity reversal control method provided by embodiments of the present disclosure, the source driving device may further comprise a random controller 400 as shown in FIG. 5. The random controller 400 comprises an input terminal configured to receive a trigger signal, and a plurality of output terminals connected in one-to-one correspondence with the control terminals of the polarity signal control units 200.

Correspondingly, the above polarity reversal control method provided by embodiments of the present disclosure further comprises: outputting, by the random controller 400, in response to receiving a valid trigger signal, a valid trigger control signal to a control terminal of one polarity signal control unit 200 at a time in a random order, and outputting a valid trigger control signal to a control terminal of each of the polarity signal control units once successively in a random order within one period after the valid trigger signal is received each time.

The above polarity reversal control method provided by embodiments of the present disclosure may further comprise receiving, by the polarity signal control unit 200, a trigger control signal every 2n-frame time, where n is a positive integer.

Embodiments of the present disclosure further provides a liquid crystal display device comprising the above-described source driving device provided by embodiments of the present disclosure. The liquid crystal display device may be any product or component having a display function such as a mobile phone, a tablet computer, a television, a display, a notebook computer, a digital photo frame, a navigator, and the like. For implementation of the display device, reference may be made to the above-described embodiments of the source driving device. The repeated description is omitted.

In the source driving device, the polarity reversal control method thereof and the liquid crystal display device provided above by embodiments of the present disclosure, a polarity signal control unit is added in the source driving device, and an output terminal of the polarity signal control unit is connected to control terminals of the first channel selection circuit and the second channel selection circuit in the positive-negative polarity reversal control unit, respectively. In this way, the polarity reversal control signal is inputted to the control terminals of the above two circuits only after passing through the polarity signal control unit. Polarity reversal condition of the polarity reversal control signal outputted by the polarity signal control unit is controlled using the trigger control signal inputted to the control terminal of the polarity signal control unit. Specifically, after the control terminal of the polarity signal control unit receives the valid trigger control signal, the polarity signal control unit will reverse the polarity of the polarity reversal control signal which is originally to be outputted and then output it. After the control terminal of the polarity signal control unit 200 receives the valid trigger control signal Ctrl again, the polarity signal control unit 200 will reverse the polarity of the polarity reversal control signal which is originally to be outputted again and then output it. The positive-negative polarity reversal control unit controls the polarity of the output signal according to the received polarity reversal control signal, thereby effectively avoiding possible DC signal residue in the 2D De-Interlace mode, as well as random DC signal residue caused by poor quality of a front-end signal, or DC signal residue caused by other reasons, and further eliminating the ghost phenomenon resulting from the DC signal residue.

It will be apparent to those skilled in the art that various modifications and variations can be made in the present disclosure without departing from the spirit and scope thereof. Thus, if these modifications and variations of the present disclosure fall within the scope of the claims of the present disclosure and their equivalent technologies, the present disclosure is also intended to include these modifications and variations.

The invention claimed is:

1. A source driving device comprising a positive-negative polarity reversal control unit and a polarity signal control unit, wherein the positive-negative polarity reversal control unit comprises:

a first channel selection circuit, a negative voltage channel and a positive voltage channel, and a second channel selection circuit which are connected successively;

wherein the first channel selection circuit is connected to two signal input terminals, respectively, and the second channel selection circuit is connected to two signal output terminals, respectively;

wherein the polarity signal control unit comprises an input terminal configured to receive a polarity reversal control signal, a control terminal configured to receive a trigger control signal, and an output terminal connected to control terminals of the first channel selection circuit and the second channel selection circuit, respectively;

wherein the polarity signal control unit is configured to: output the received polarity reversal control signal; perform polarity reversal on a polarity reversal control signal to be outputted in response to receiving a valid trigger control signal each time;

wherein a plurality of polarity signal control units are disposed in one-to-one correspondence with a plurality of positive-negative polarity reversal control units, and input terminals of the plurality of polarity signal control units are connected to a same polarity reversal control signal input terminal;

wherein the source driving device further comprises a shift controller, wherein the shift controller comprises an input terminal configured to receive a trigger signal, and a plurality of output terminals connected in one-to-one correspondence with control terminals of the plurality of polarity signal control units, and wherein the shift controller is configured to, in response to receiving a valid trigger signal, output the valid trigger control signal to the control terminals of the plurality of polarity signal control units, successively, in order.

2. The source driving device according to claim 1, wherein the control terminal of the polarity signal control unit receives the valid trigger control signal once every 2n-frame time, n being a positive integer.

3. A liquid crystal display device comprising the source driving device according to claim 1.

4. The liquid crystal display device according to claim 3, wherein the control terminal of the polarity signal control unit receives the valid trigger control signal once every 2n-frame time, n being a positive integer.

5. A polarity reversal control method of a source driving device, wherein the source driving device comprises a positive-negative polarity reversal control unit and a polarity signal control unit, wherein the positive-negative polarity reversal control unit comprises:

a first channel selection circuit, a negative voltage channel and a positive voltage channel, and a second channel selection circuit, wherein each of the first channel selection circuit, negative and positive voltage channels, and second channel selection circuit are connected successively, wherein the first channel selection circuit is connected to two signal input terminals, respectively, and the second channel selection circuit is connected to two signal output terminals, respectively;

wherein the polarity signal control unit comprises:

an input terminal configured to receive a polarity reversal control signal, a control terminal configured to receive a trigger control signal, and an output terminal connected to control terminals of the first channel selection circuit and the second channel selection circuit, respectively; and wherein the polarity reversal control method comprises:

outputting, by the polarity signal control unit, the received polarity reversal control signal to the control terminals of the first channel selection circuit and the second channel selection circuit to which the polarity signal control unit is connected, performing polarity reversal on a polarity reversal control signal to be outputted in response to receiving a valid trigger control signal each time;

wherein a plurality of polarity signal control units are disposed in one-to-one correspondence with a plurality of positive-negative polarity reversal control units, and input terminals of the plurality of polarity signal control units are connected to a same polarity reversal control signal input terminal, and the polarity reversal control method further comprises receiving, by the plurality of polarity signal control units, the polarity reversal control signal outputted by corresponding polarity reversal control signal input terminal;

wherein the source driving device further comprises a shift controller, the shift controller comprising an input terminal configured to receive a trigger signal, and a plurality of output terminals connected in one-to-one correspondence with the control terminals of the plurality of polarity signal control units, and wherein the polarity reversal control method further comprises: outputting, by the shift controller, in response to receiving a valid trigger signal, a valid trigger control signal to the control terminals of the plurality of polarity signal control units, successively, in order.

6. The polarity reversal control method according to claim 5, further comprising receiving, by the polarity signal control unit, the trigger control signal once every 2n-frame time, n being a positive integer.

7. A source driving device comprising a positive-negative polarity reversal control unit and a polarity signal control unit, wherein the positive-negative polarity reversal control unit comprises:

a first channel selection circuit, a negative voltage channel and a positive voltage channel, and a second channel selection circuit which are connected successively;

wherein the first channel selection circuit is connected to two signal input terminals, respectively, and the second channel selection circuit is connected to two signal output terminals, respectively;

wherein the polarity signal control unit comprises an input terminal configured to receive a polarity reversal control signal, a control terminal configured to receive a trigger control signal, and an output terminal connected to control terminals of the first channel selection circuit and the second channel selection circuit, respectively;

wherein the polarity signal control unit is configured to: output the received polarity reversal control signal; perform polarity reversal on a polarity reversal control signal to be outputted in response to receiving a valid trigger control signal each time;

wherein a plurality of polarity signal control units are disposed in one-to-one correspondence with a plurality of positive-negative polarity reversal control units, and input terminals of the plurality of polarity signal control units are connected to a same polarity reversal control signal input terminal;

wherein the source driving device further comprises a random controller, wherein the random controller comprises an input terminal configured to receive a trigger signal and a plurality of output terminals connected in one-to-one correspondence with control terminals of the plurality of polarity signal control units, and wherein the random controller is configured to, in response to receiving a valid trigger signal, output the valid trigger control signal to a control terminal of one of the plurality of polarity signal control units at a time in a random order, and output the valid trigger control signal to a control terminal of each of the plurality of polarity signal control units once successively in a random order within one period after the valid trigger signal is received each time.

8. The source driving device according to claim 7, wherein the control terminal of the polarity signal control unit receives the valid trigger control signal once every 2n-frame time, n being a positive integer.

9. A liquid crystal display device comprising the source driving device according to claim 7.

10. The liquid crystal display device according to claim 9, wherein the control terminal of the polarity signal control unit receives the valid trigger control signal once every 2n-frame time, n being a positive integer.

* * * * *